United States Patent [19]

Grant et al.

[11] 4,125,443

[45] Nov. 14, 1978

[54] ELECTROLYTIC PRODUCTION OF FLUORINE

[75] Inventors: Albert E. Grant; Stanley Wainwright, both of Preston, England

[73] Assignee: British Nuclear Fuels Ltd., Warrington, England

[21] Appl. No.: 837,711

[22] Filed: Sep. 29, 1977

[30] Foreign Application Priority Data

Oct. 19, 1976 [GB] United Kingdom ..... 43385/76

[51] Int. Cl.[2] ..... C25B 1/24; C25B 15/08

[52] U.S. Cl. ..... 204/60; 204/239; 204/247; 204/274

[58] Field of Search ..... 204/60, 239, 274, 243 R, 204/244–247

[56] References Cited

U.S. PATENT DOCUMENTS

| | | | |
|---|---|---|---|
| 2,879,212 | 3/1959 | Hill et al. | 204/60 |
| 3,642,603 | 2/1972 | Sakai et al. | 204/239 X |
| 3,707,457 | 12/1972 | Pollock | 204/239 |
| 3,839,180 | 10/1974 | Takaysu | 204/274 X |

*Primary Examiner*—John H. Mack
*Assistant Examiner*—D. R. Valentine
*Attorney, Agent, or Firm*—Larson, Taylor and Hinds

[57] ABSTRACT

In the production of fluorine by electrolysis of a fused electrolyte containing potassium fluoride and hydrogen fluoride the electrolyte is circulated from a tank, through a heat exchanger, through one or more electrolytic cells and is returned to the tank. The heat exchanger controls the temperature of the circulating electrolyte leaving the electrolytic cell or cells at the desired value in the range 75°–110° C.

11 Claims, 1 Drawing Figure

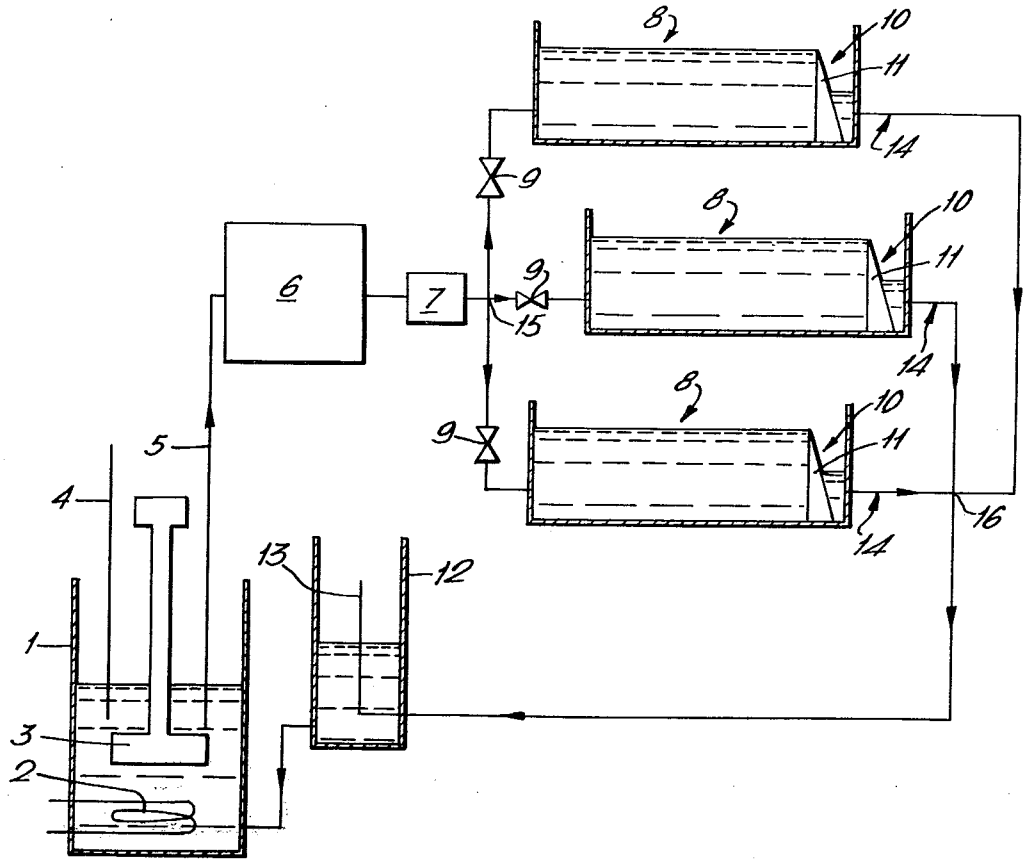
1
2
3
4
5
6
7
8
9
10
11
12
13
14
15
16

ELECTROLYTIC PRODUCTION OF FLUORINE

BACKGROUND OF THE INVENTION

This invention relates to the electrolytic production of fluorine.

The production of fluorine by the electrolysis of a fused electrolyte containing potassium fluoride and hydrogen fluoride is well known. During the electrolysis heat is liberated and therefore the electrolyte must be cooled if the electrolysis is to proceed at a constant temperatature. The cooling of the electrolyte has been performed by using cooling tubes placed in the electrolyte in the electrolytic cell and/or by cooling the outer walls of the electrolytic cell by surrounding those walls by a jacket through which a cooling medium is passed.

In one form of apparatus used for the large scale production of fluorine the electrolyte is cooled by using internal mild steel cooling coils which also act as the cathodes of the electrolytic cell. Cooling is effected by passing water through these cooling coils. Should these coils become holed, as may occur when, for example, an anode breaks or becomes detached from its support and forms a short circuit between the cathode and other anodic electrodes within the cell, the electrolyte becomes contaminated with water. The electrolytic cell has to be taken out of service whilst the cathode is repaired or replaced and the electrolyte is changed.

SUMMARY OF THE INVENTION

According to one aspect of the present invention there is provided apparatus for the production of fluorine by electrolysis of a fused electrolyte containing potassium fluoride and hydrogen fluoride the apparatus comprising a tank for holding the fused electrolyte, a heat exchanger for removing heat from the electrolyte, one or more electrolytic cells, means for circulating the fused electrolyte from the tank to the electrolytic cell or cells through the heat exchanger, means for monitoring the temperature of the circulating electrolyte and means responsive to said temperature-monitoring means for controlling the amount of heat removed from the circulating electrolyte so that the temperature of the circulating electrolyte is controlled.

According to a further aspect of the present invention there is provided a process for the production of fluorine by electrolysis of a fused electrolyte containing potassium fluoride and hydrogen fluoride in which the fused electrolyte is circulated from a tank to one or more electrolytic cells through a heat exchanger to remove heat from the circulating electrolyte so that the temperature of the electrolyte is controlled such that the temperature of the electrolyte as it leaves the electrolytic cell or cells is maintained at a temperature in the range 75 to 110° C.

During the electrolysis of the fused electrolyte to produce hydrogen and fluorine, the concentration of hydrogen fluoride in the electrolyte falls. The preferred hydrogen fluoride concentration is within the range 39 to 43% by weight. To preserve any desired level within this range it is necessary to add hydrogen fluoride to the electrolyte as the electrolysis proceeds. This is conveniently achieved by adding the hydrogen fluoride to the electrolyte in the electrolyte circulating tank. A continuous monitor for the hydrogen fluoride content of the electrolyte may be placed between the circulating tank and the one or more electrolytic cells. This monitor may be so arranged that it controls the amount of hydrogen fluoride being added to the electrolyte so as to preserve a substantially constant and optimised concentration of hydrogen fluoride in the electrolyte.

The heat exchanger may be cooled by a gas such as air or a liquid such as water and the rate of cooling should preferably be such that the temperature of the electrolyte leaving the electrolytic cell is maintained at the desired temperature within the range 75°-110° C. preferably within the range 90°-100° C.

The electrolyte level in the electrolytic cell or cells may be maintained at a constant level by providing the or each cell with a weir which is adjacent the outlet end of the cell and which is shaped so that the flow over the weir is non-turbulent. Preferably means for removing hydrogen which becomes entrained in the circulating electrolyte are provided. Conveniently such means comprise a control tank downstream of the cell or cells into which the electrolyte passes by way of an upwardly-directed tube extending above the level of the electrolyte in the control tank.

DESCRIPTION OF THE DRAWING

The invention will be illustrated by the following description of a process and apparatus for the production of fluorine by electrolysis of a fused electrolyte. The description is given by way of example only and has reference to the single FIGURE of the accompanying drawing which is a diagrammatic representation of apparatus in which the electrolyte is circulated through three electrolytic cells.

DESCRIPTION OF THE PREFERRED EMBODIMENT

The electrolyte which comprises a mixture of potassium fluoride and hydrogen fluoride preferably containing 42 to 43% by weight of hydrogen fluoride is held in a tank 1 fitted with a steam heating coil 2, a submersible pump 3 and a feed pipe 4 for the addition of hydrogen fluoride to the electrolyte in the tank 1. The steam heating coil 2 is used to melt the electrolyte initially and to ensure that the electrolyte temperature remains above the temperature at which the electrolyte solidifies. The submersible pump 3 pumps the electrolyte through a discharge pipe 5 to a heat exchanger 6 which may be air or water cooled. In one form of heat exchanger the circulating electrolyte is cooled by drawing air over a plurality of cooling tubes through which the circulating electrolyte is passed. The volume of air passing over the cooling tubes is controlled by louvres which regulate the volume of air passing into the heat exchanger. Pipes carrying steam may be used to heat the incoming air. A temperature sensor connected to the outlet of the heat exchanger monitors the temperature of the electrolyte leaving the heat exchanger and controls the position of the louvres and the amount of steam passing through the steam-carrying pipes so that the temperature of the electrolyte leaving the heat exchanger is at the desired value. Conveniently the heat exchanger maintains the temperature of the electrolyte entering the electrolytic cell at a predetermined value in the range 85°-95° C. A monitor 7 continuously monitors the hydrogen fluoride concentration in the electrolyte and controls the flow of hydrogen fluoride through the feed pipe 4 so that a substantially constant concentration of hydrogen fluoride in the electrolyte is maintained. The electrolyte leaving the monitor 7 passes into electrolytic cells 8 which are connected in parallel between the points 15 and 16 and are shown at different levels in the drawing only for the sake of clarity through flow control valves 9. A weirbox 10 containing a weir 11 is fitted adjacent the outlet end of each electrolytic cell 8 to ensure a constant electrolyte level within the cell 8. The weirs 11 are shaped so that the flow over them is non-turbulent to minimise the entrainment of hydrogen gas in the circulating electrolyte. The electrolyte leaving the weir box 10 passes into a level control tank 12 through an upwardly-directed inlet tube 13 the upper end of which is at all times above the level of the electrolyte in the control tank 12. As the electrolyte passes out of the end of the inlet tube 13 entrained hydrogen gas can escape. The electrolyte flow into the control tank 12 is arranged to ensure that under normal flow conditions the level of electrolyte in each weir box 10 is controlled such that it does not rise above the level of the weir 11 or fall below the level of the outlet pipe 14 from the weir box. The control tank 12 could be replaced by other designs to achieve the same objective.

The electrolytic cell 8 may be fitted with carbon anodes (not shown) plate cathodes of mild steel and a skirt separating the fluorine and hydrogen gaseous zones which may be manufactured from Monel (Registered Trade Mark) or magnesium alloy. The use of plate cathodes combined with external cooling enables more electrode pairs to be placed in a cell thus significantly increasing the output of the cell. The circulation of electrolyte through the cell facilitates the maintenance of an optimum temperature and HF concentration within the electrolyte and consequently minimises local fluctuations in the hydrogen fluoride concentration within the cell, which is an undesirable feature of currently operated cells.

The number of electrolytic cells connected in parallel is not limited to three as shown. The invention finds a particular application where large amounts of fluorine are required and many electrolytic cells are used. Thus a plant may conveniently have twelve electrolytic cells connected in parallel and fed from one tank by splitting the electrolyte flow downstream of the monitor 7, directing it separately through each cell and combining the flow again upstream of the control tank 12.

By arranging for the connection of a number of cells in parallel the control of temperature and hydrogen fluoride concentration to give optimum performance is simplified because separate facilities are not required for each cell but the invention is also applicable to the operation of a single cell.

With several cells connected in parallel the flow into each cell is readily controlled so that the electrolyte flow is evenly distributed between the cells by adjustment of valve 9, associated with each cell. In the event that one or more cells are operating below the maximum, the flows can be readjusted manually. If required, the valves may be automatically adjusted based on a preferred maximum cell operating temperature.

We claim:

1. Apparatus for the production of flourine by electrolysis of a fused electrolyte containing potassium flouride and hydrogen flouride the apparatus comprising a tank for holding the fused electrolyte, a heat exchanger for removing heat from the electrolyte, one or more electrolytic cells, means for circulating the fused electrolyte from the tank to the electrolytic cell or cells through the heat exchanger, means for monitoring the temperature of the circulating electrolyte and means responsive to said temperature monitoring means for controlling the amount of heat removed from the circulating electrolyte so that the temperature of the circulating electrolyte as it leaves the electrolytic cell or cells is maintained at a temperature within the range of 90°–100° C.

2. Apparatus for the production of fluorine as claimed in claim 1 in which a plurality of electrolytic cells are connected in parallel.

3. Apparatus for the production of fluorine as claimed in claim 1 wherein a monitor for the hydrogen fluoride concentration in the electrolyte is provided and means are provided to supply hydrogen fluoride to the electrolyte so that the desired substantially constant fluoride concentration is maintained.

4. Apparatus for the production of fluorine as claimed in claim 1 wherein the or each electrolytic cell is provided with a weir adjacent its outlet end to maintain the level of electrolyte within the cell, the weir being shaped so that the flow of electrolyte over it is non-turbulent.

5. Apparatus as claimed in claim 1 wherein means are provided to remove entrained hydrogen from the electrolyte which has passed through the or one of the electrolytic cells.

6. A process for the production of fluorine by electrolysis of a fused electrolyte containing potassium fluoride and hydrogen fluoride in which the fused electrolyte is circulated from a tank to one or more electrolytic cells through a heat exchanger to remove heat from the circulating electrolyte so that the temperature of the electrolyte is controlled such that the temperature of the electrolyte as it leaves the electrolytic cell or cells is maintained at a temperature in the range 90° to 100° C.

7. A process for the production of fluorine as claimed in claim 6 in which a plurality of electrolyte cells are connected in parallel.

8. A process for the production of fluorine as claimed in claim 6 in which the concentration of hydrogen fluoride in the electrolyte is in the range 39 to 43%.

9. A process for the production of fluorine as claimed in claim 6 in which the concentration of hydrogen fluoride in the electrolyte is in the range 42 to 43%.

10. A process for the production of fluorine as claimed in claim 6 in which the level of the electrolyte in the or each electrolyte cell is maintained constant by a weir adjacent the outlet end of the or each electrolytic cell, the flow of the electrolyte over the weir being non-turbulent.

11. A process for the production of fluorine as claimed in claim 6 in which the electrolyte which has passed through the electrolytic cell or cells is passed in to a control tank through an upwardly-directed tube extending above the electrolyte level in the control tank to release entrained hydrogen.

* * * * *